US008556678B2

(12) United States Patent
Siders et al.

(10) Patent No.: US 8,556,678 B2
(45) **Date of Patent: *Oct. 15, 2013**

(54) SYSTEM AND METHOD PRE-BLOCKING OPHTHALMIC LENS FOR PROCESSING INCLUDING ARTICULATION EDGING

(75) Inventors: Larry K. Siders, Wooster, OH (US); Donald F. Baechtel, Lyndhurst, OH (US)

(73) Assignee: NCRX Optical Solutions, Inc., Medina, OH (US)

( * ) Notice: Subject to any disclaimer, the term of this patent is extended or adjusted under 35 U.S.C. 154(b) by 195 days.

This patent is subject to a terminal disclaimer.

(21) Appl. No.: 12/942,656

(22) Filed: Nov. 9, 2010

(65) Prior Publication Data

US 2011/0281502 A1 Nov. 17, 2011

Related U.S. Application Data

(60) Continuation-in-part of application No. 11/838,867, filed on Aug. 14, 2007, now Pat. No. 7,828,624, which is a continuation-in-part of application No. 11/553,708, filed on Oct. 27, 2006, now Pat. No. 7,371,154, which is a continuation-in-part of application No. 11/279,092, filed on Apr. 7, 2006, now Pat. No. 7,128,638, which is a division of application No. 11/191,422, filed on Jul. 27, 2005, now Pat. No. 7,086,928, which is a division of application No. 10/420,023, filed on Apr. 21, 2003, now Pat. No. 6,953,381, which is a division of application No. 09/760,623, filed on Jan. 16, 2001, now Pat. No. 6,568,990.

(60) Provisional application No. 60/822,282, filed on Aug. 14, 2006, provisional application No. 60/176,658, filed on Jan. 18, 2000.

(51) Int. Cl.
*B24B 49/00* (2012.01)

(52) U.S. Cl.
USPC ..... 451/5; 451/43

(58) Field of Classification Search
USPC ..... 451/5, 11, 43, 44
See application file for complete search history.

(56) References Cited

U.S. PATENT DOCUMENTS

| | | | | | |
|---|---|---|---|---|---|
| 2,216,182 | A | * | 10/1940 | Boeder et al. | 351/159.45 |
| 2,890,551 | A | * | 6/1959 | Dalton | 451/42 |
| 3,226,887 | A | * | 1/1966 | Rudd et al. | 451/42 |
| 4,203,259 | A | * | 5/1980 | Haddock | 451/227 |
| 5,210,695 | A | * | 5/1993 | Wood | 700/164 |
| 5,964,647 | A | * | 10/1999 | Henky | 451/43 |

(Continued)

*Primary Examiner* — David B Thomas
(74) *Attorney, Agent, or Firm* — Blynn L. Shideler; Krisanne Shideler; BLK Law Group

(57) ABSTRACT

A method and system for pre-blocking ophthalmic lenses for processing including articulation edging is described. Lens blanks are blocked in this method without prior knowledge of lens prescription variables or frame size and shape dimensions. This blocking can be done at a remote mass production manufacturing facility. The pre-blocked lenses would then be inventoried at the lens manufacturing location. No de-blocking and re-blocking is required between the surfacing, for those lens blanks requiring surfacing, and edging processes so the lens blanks remain on their blocks from start to finish. If surfacing is required, both surfacing and edging are performed on the same machine with no interruptions between the two processes. Machine readable indicia on the Lens-Block Assemblies for Lens Blank species identification is described. Pre-blocking of finished uncut lenses for edging using articulation edging is also described.

19 Claims, 4 Drawing Sheets

(56) References Cited

U.S. PATENT DOCUMENTS

| | | | | |
|---|---|---|---|---|
| 6,517,203 | B1 * | 2/2003 | Blum et al. | 351/159.39 |
| 6,568,990 | B2 | 5/2003 | Siders et al. | |
| 6,902,468 | B2 * | 6/2005 | Luderich et al. | 451/9 |
| 6,953,381 | B2 | 10/2005 | Siders et al. | |
| 7,086,928 | B2 | 8/2006 | Siders et al. | |
| 7,128,638 | B2 | 10/2006 | Siders et al. | |
| 7,322,082 | B2 * | 1/2008 | Natsume et al. | 29/260 |
| 7,803,035 | B2 * | 9/2010 | Nauche et al. | 451/5 |
| 7,828,624 | B2 | 11/2010 | Siders et al. | |
| 2001/0051490 | A1 | 12/2001 | Siders et al. | |
| 2002/0140899 | A1 * | 10/2002 | Blum et al. | 351/159 |
| 2003/0157869 | A1 * | 8/2003 | Luderich et al. | 451/240 |
| 2003/0181133 | A1 | 9/2003 | Siders et al. | |
| 2005/0266772 | A1 | 12/2005 | Siders et al. | |
| 2006/0166609 | A1 | 7/2006 | Siders et al. | |
| 2006/0217036 | A1 * | 9/2006 | Meunier et al. | 451/5 |
| 2007/0167112 | A1 | 7/2007 | Siders et al. | |
| 2008/0026679 | A1 | 1/2008 | Siders et al. | |
| 2009/0305614 | A1 * | 12/2009 | Nauche et al. | 451/43 |

* cited by examiner

SYSTEM AND METHOD PRE-BLOCKING OPHTHALMIC LENS FOR PROCESSING INCLUDING ARTICULATION EDGING

RELATED APPLICATIONS

This application is a continuation-in-part of U.S. patent application Ser. No. 11/838,867 entitled "Method of Local Manufacture of Ophthalmic Lens Using Remotely Assembled Pre-Blocked Lens" (the '867 application).

The '867 application published as United States patent application publication number 2008-0026679 and is now issued as U.S. Pat. No. 7,828,624. The '867 application claims the benefit of provisional patent application Ser. No. 60/822,282 filed Aug. 14, 2006 entitled "System and Method for Ophthalmic Lens Manufacture."

The '867 application is a continuation-in-part of U.S. patent application Ser. No. 11/553,708 entitled "Dual Ophthalmic Lens Machining Platform and Simultaneous Ophthalmic Lens Manufacturing Method" (the '708 application). The '708 application published as United States patent application publication number 2007-0167112 and is now issued as U.S. Pat. No. 7,371,154.

The '708 application is a continuation-in-part of U.S. patent application Ser. No. 11/279,092 entitled "System and Method for Ophthalmic Lens Manufacture" filed on Apr. 7, 2006 (the '092 application). The '092 application published as United States patent application publication number 2006-0166609 and is now issued as U.S. Pat. No. 7,128,638.

The '092 application is a division of U.S. patent application Ser. No. 11/191,422 entitled "System and Method for Ophthalmic Lens Manufacture" filed on Jul. 27, 2005 (the '422 application). The '422 application published as United States patent application publication number 2005-0266772 and is now issued as U.S. Pat. No. 7,086,928.

The '422 application is a division of U.S. patent application Ser. No. 10/420,023 entitled "System and Method for Ophthalmic Lens Manufacture" filed on Apr. 21, 2003 (the '023 application). The '023 application published as United States patent application publication number 2003-0181133 and is now issued as U.S. Pat. No. 6,953,381.

The '023 application is a division of U.S. patent application Ser. No. 09/760,623 entitled "System and Method for Ophthalmic Lens Manufacture" filed on Jan. 16, 2001 (the '623 application). The '623 application published as United States patent application publication number 2001-0051490 and is now U.S. Pat. No. 6,568,990.

The '623 application claims the benefit of U.S. provisional patent application Ser. No. 60/176,658 entitled "System and Method for Ophthalmic Lens Manufacture" filed on Jan. 18, 2000.

This application hereby incorporates by reference the above identified United States patent application publications and United States patents, in their entirety.

BACKGROUND

1. Field of the Invention

This invention relates to the manufacture of ophthalmic lenses. Specifically this invention relates to a method for manufacturing ophthalmic lenses using pre-blocked lens blanks which includes articulation edging.

2. Background of the Invention

Ophthalmic lens manufacturing typically requires many steps, devices and machines operated by highly trained technicians. For example, lens generation typically involves a skilled technician mounting a lens blank on a block responsive to a desired finished lens prescription in a blocking process. Blocking is the process of rigidly affixing a lens blank to a holding device in a precise orientation in order to perform forceful machining operations on the blocked lens blank. De-blocking is the process of removing a lens blank, generally at least partially processed, from a lens blank. Re-blocking, is a subset of blocking, and is blocking a lens blank that has been previously blocked, such as re-blocking for edging following surfacing operations. Pre-blocking within the meaning of this application is a sub-set of blocking and refers to a blocking procedure that requires that the lens blanks be blocked without prior knowledge of the lens prescription variables and without information about the frame size and shape.

In the art of manufacturing ophthalmic lenses today, blocking for surfacing generally requires substantive lens prescription information, and in order to optimize lens thickness, frame dimension information is also needed. In the art today, blocking for edging requires both lens prescription information and frame dimension information. Significant amounts of time are required for blocking. Each blocking step introduces some error. Manual blocking for surfacing is very complicated and requires a high degree of expertise to perform. Expensive devices are in use to simplify the process. Typical blocking media (chemical compounds used for blocking) are heated to the liquid form, i.e. melted, so that it flows over and conforms to the surfaces of the lenses to be blocked. This heated media must be allowed to cool sufficiently, generally about 12 to 15 minutes, before machining can commence. Without sufficient cooling there is a high risk of auto or self de-blocking resulting in a scrapped lens blank. Further complicating the process is that optical flaws can be created if the blocking media is too hot. The blocking compounds used in the art today are too expensive to dispose of after each use, so complicated, time consuming, and messy reclamation systems are employed for recycling.

Following blocking for surfacing of a lens blank in prior art procedures, the technician then uses one machine that performs surfacing on the lens blank and a second machine for fining and/or polishing with a lap tool. Operation of these machines produces finished uncut lenses, which only require edging to become finished lenses. These then need to be de-blocked and marked-up and re-blocked again for edging on yet another machine. Each of these steps requires expensive skilled operator intervention. Each machine used in the process requires lab space and has associated acquisition and maintenance costs.

Some attempts to address the limitations of the conventional prior art processes have been proposed, for example in what has been called the "Coburn process" there is a teaching of how a lens can be blocked for both surfacing and edging without de-blocking and re-blocking between the surfacing and edging steps, but the "Coburn process" produces skewed edges in the final lens configuration that limits its use.

Further, a company known as Super Systems, Inc. has a system for pseudo-pre-blocking for surfacing Front Surface Multi-focals and Semi-Finished Single Vision lens blanks. This process is referenced as pseudo-pre-blocking as the front surface Multi-focals are blocked with a "pre-determined amount of inset and drop" which places the optical center at a predetermined position relative to the multifocal feature. The pseudo-pre-blocking in this system cannot be economically done due to the pre-determined amount of inset and drop, and thus is not commercially done, for lenses with prism in the lens prescription specification. Hundreds of lens types would each have to be pseudo-pre-blocked with hundreds of different possible prism specifications. Lens thickness can not be systematically optimized when the optical center location is predetermined as it is in this system. This pseudo-pre-blocking system is for surfacing of lenses only. Semi-finished lenses made with this system must still be de-blocked, marked-up, and re-blocked for edging.

Spoilage occurs when lens blanks are surfaced or edged for the wrong eye or for the wrong job and when the selected lens blanks are made of the wrong type of lens material or have the wrong coatings. Therefore there is a need for a system of verifying that the correct species of lens blank is being used when making a lens. Further, there is a need for automatically verifying that the correct species of lens blank is being used for making a lens.

There remains is a need for a method of ophthalmic lens manufacture that may eliminate or reduce the amount of skilled labor required and there is a need for a method of ophthalmic lens manufacture that may reduce the number of machines or devices required to produce ophthalmic lenses.

SUMMARY OF THE INVENTION

It is an object of an exemplary embodiment to provide systems and methods for ophthalmic lens manufacture which may eliminate or reduce the amount of skilled labor required to produce ophthalmic lenses from lens blanks and which may reduce the number of machines or devices required to fabricate ophthalmic lenses from lens blanks. In an exemplary embodiment, the method of pre-blocking may be used that is thus independent of the frame data and prescription specifications. In such an embodiment, the lens blank may be pre-blocked for use with both surfacing and edging. In one embodiment of the invention edging includes articulation edging which involves constantly changing the angle of the tool axis of a rotating machining edging tool relative to the lens' axis of rotation during edging in order to keep the edges substantially parallel to the normal at the geometric center of the lens. The geometric center of a finished and edged lens is a point generally on the surface of the lens that is at the intersection of two lines. One of the lines being horizontally oriented and equidistant from the topmost point on the edge of the lens and the bottommost point on the edge of the lens. The other line being vertically oriented and equidistant from the point on the edge of the lens located the furthest nasally and another point on the edge of the lens located the furthest temporally.

The foregoing objects may be accomplished in one exemplary embodiment by a system and method for ophthalmic lens manufacture that employs computer numerically controlled (CNC) machining techniques that are operative to generate and edge semi-finished lenses and to edge finished uncut lenses. Examples of a system or manufacturing platform for ophthalmic lens manufacture which may be used in exemplary embodiments of the invention are described in U.S. Pat. Nos. 7,828,624; 7,128,638; 7,086,928; 6,953,381; and 6,568,990, and U.S. published application nos. 2008-0026679, 2007-0167112; 2006-0166609; 2005-0266772; 2003-0181133 and 2001-0051490 which are hereby incorporated herein by reference in their entireties. This manufacturing platform is referenced herein as the NCRx Ophthalmic Lens Manufacturing System or the NOLM System.

As will be appreciated, the foregoing objects and examples are exemplary and embodiments need not meet all or any of the foregoing objects, and need not include all or any of the exemplary features described herein. Additional aspects and embodiments within the scope of the claims will be devised by those having skill in the art based on the teachings set forth herein. These and other advantages of the present invention will be described in the following description taken together with the attached figures win which like reference numeral represent like elements throughout.

DETAILED DESCRIPTION OF THE INVENTION

The NCRx Ophthalmic Lens Manufacturing System or NOLM System provides for pre-blocking of essentially all types of lens blanks in current use for manufacturing ophthalmic lenses. As the lens blocking process is independent of all prescription and frame information, the lens blanks used in the NOLM System can be economically assembled at a mass production manufacturing facility as described in greater detail in the parent patent application. For lens blanks requiring surfacing and edging, only one blocking procedure is done for both surfacing and edging in the NOLM System. There is no need for de-blocking after surfacing and re-blocking for edging. The NOLM System may proceed directly from the surfacing process into the edging process without removing the work pieces from the machine. As noted in the advantageous machining platform described in the preceding applications, both lenses of a pair of lenses are manufactured at the substantially the same time. Finished uncut single vision lenses that only require edging are also pre-blocked for edging particularly for the use of articulation edging as described below.

As will be apparent from the following discussion, combining pre-blocking with no de-blocking and re-blocking between surfacing and edging, and with the surfacing of tilted surfaces that can be accomplished on the NCRx Ophthalmic Lens Manufacturing System, the present invention provides for rapid production (typically 5 to 20 minutes) of Ophthalmic Lenses at the point of sale by operators with little knowledge of optics and little knowledge about the manufacture of lenses. Further, this system is capable of making "back surface free form" optical surfaces resulting in optimized optics that have less peripheral distortion than standard lenses. Free form surfacing capability also greatly reduces inventory requirements.

As alluded to above, in the present system and method, blocking is easy and takes little time and can require no heated blocking media. There is no need to de-block and re-block lens blanks that require both surfacing and edging, so no error is introduced by multiple blocking steps. Very small amounts of inexpensive adhesives are used, so there is no need for expensive, messy, and time consuming reclamation of blocking media.

Figure 3:
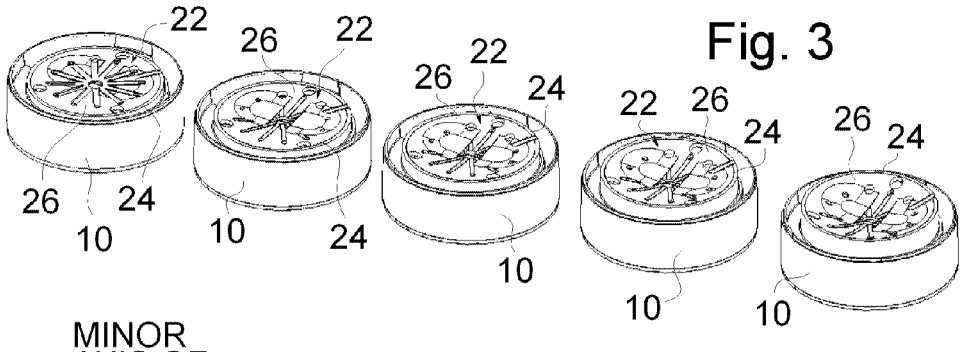
FIG. 3 shows a schematic perspective view of one complete set of blocks for use with the present invention

Not all types of lens blanks can be blocked the same way for machining on the NCRx Ophthalmic Lens Manufacturing System. However, the universe of ophthalmic lens blanks 20 can be effectively divided into four classes resulting in only four different, though very similar, blocking schemes. The same physical block configuration can be used in all four of the schemes. As few as two different block 10 shapes, or species, can be used for blocking the entire range of base curves. However, five to six different shapes or species of blocks 10, as shown in FIG. 3, are more practical for a comprehensive lens making system from the standpoint of the expenditure of adhesive material which need not be re-used in this system.

The 4 classes of lens blanks in this blocking system are:

Class 1. Finished Uncut Lens Blanks 20. These lens blanks 20 come surfaced on both sides and require only edging to form finished lenses 30.

Class 2. Semi-Finished Single Vision Lens Blanks 20 (SFSV). These blanks 20 require both surfacing (on the back surface) and edging to form finished lenses 30.

Class 3. Front Surface Lined Multifocal Semi-Finished Blanks 20. These blanks 20 require both surfacing and edging to form finished lenses 30.

Class 4. Unusual Lens Blanks 20. This class would include Non-rotationally Symmetric Front Surface Lens Blanks like Front Surface PAL's (Progressive Add Lenses) and lens blanks that would not easily seat on standard blocks 10 made for spherical front surfaces like Executive Style Multifocals.

Figure 1:
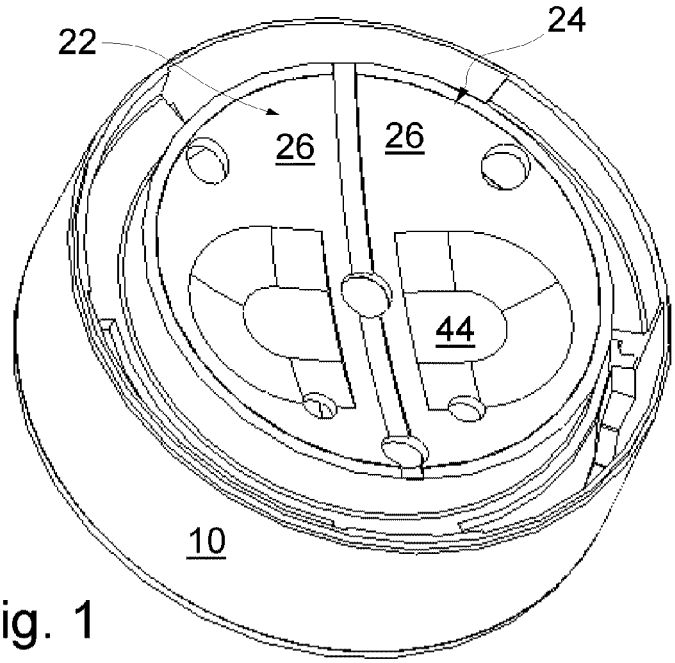
FIG. 1 is a perspective view of a lens side of a block for manufacturing of ophthalmic lens using pre-blocked lens blanks according to the present invention as described hereinafter.
Figure 2:
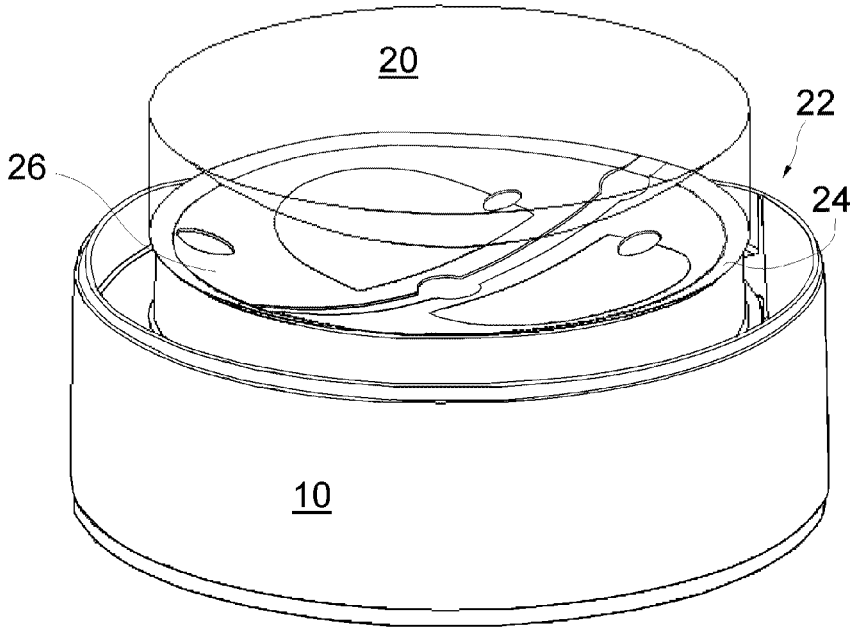
FIG. 2 shows a schematic perspective view of a pre-mounted lens blank and block assembly used for generating an ophthalmic lens from a lens blank in accordance with the present invention.

The blocks 10 used in the NCRx Pre-Blocking system are precision molded plastic blocks 10 and are shown in FIGS. 1-2. The blocks 10 are molded from inexpensive and easily machinable plastics. The block material must be easily machinable since the edging tools 32 cut into the blocks 10 during the edging process.

There are features on one side of all the blocks 10 that enable easy manual chucking of the blocks onto the chucks of the NCRx machining platform. These features produce chucking that is precisely "indexed". That is, the blocks 10 can only go onto the associated machine chucks in one orientation, and when securely chucked, are thus precisely oriented on the chucks. When blocked and chucked in this manner, the location of any point on any surface of the mounted lens blank 20 is known to the required degree of precision.

The lens side 22 of the blocks 10 includes features for accurately aligning the convex front surfaces of the lens blanks 20 to the blocks 10. A key feature on this lens side 22 of the blocks 10 is the locator ring 24. The front surfaces of the lens blanks 20 are placed against the locator rings 24 on the blocks 10 to facilitate precise orientation of the lens blanks 20 relative to the coordinates of the blocks 10.

There are several species of molded blocks 10 according to the radius of curvature of the cavity 26 on the "blocking" side 22 of the block 10. FIG. 3 shows five different blocks having five different degrees of concavity for receiving lens blanks 20 with different base curves. By using blocks 10 where the radius of concavity of the cavity 26 closely approximates the front surface radius of the lens blanks 20 that they receive, a minimal amount of adhesive material can be used for affixing the lens blanks 20 to the blocks 10.

Many types of adhesives may be used for affixing the blanks 20 to the blocks 10. Any adhesive that does not affect the front lens blank surface (either physically or chemically) of the blank 20 may be used directly in contact with the lens blank 20. Most inexpensive adhesives negatively affect the lens front surface (cannot be easily removed from the finished lens 30 or they otherwise ruin the lens 30). Use of these adhesives requires that a protective film be applied to the lens surface of the blank 20 before blocking. There are many adhesives that can be applied at room temperature. The use of these is preferred in the present system so as not to thermally impact the plastic material of the lens blank 20. The parent application, incorporated herein by reference includes a greater detailed description of adhesives.

Turning to surfacing of those lens blanks 20 that require surfacing, in the present invention, there are two machining steps in the lens surfacing process on the NOLM System. The first step involves using a small radius (~4-5 mm radius) high speed rotary cutting tool under computer numeric control (CNC) that mills away lens blank 20 material to produce the approximate shape of the final lens 30 surface. In this first step, the lens blank 20 is rotated as the high speed rotary surfacing tool moves across the surface of the lens blank 20 producing the approximate shape of the surface of the final lens 30 surface. The second machining step is a precision lathing step that produces a surface with high fidelity to the desired surface form of the lens 30. Further processing steps are then performed on the machine to bring the surfaces of the lens 30 up to full optical transparency and smoothness (Ra).

In the present invention, edging is done with high speed rotary milling tools 32. The shape of the edge of the lens 30 (Flat or V-Beveled or Grooved) is imparted by the profile of the edging tool 32, examples of which are shown in detail in the parent and other preceding applications. During the edging process, the lens blank 20 is rotated as the high speed spindle works its way inward from the periphery of the lens blank 20 creating the size, shape, and edge contour required of the finished lens 30.

Blocking Class 1—Finished Uncut Lens Blanks 20:

In the preferred embodiment of the Pre-blocking scheme for edging Class 1 Finished Uncut Lens Blanks 20, the lens blanks 20 are affixed to the blocks 10 with the optical centers 34 placed over the center of the block 10 and with the major axis 36 of astigmatism oriented along the 0-180 meridian of the block coordinates. In other embodiments, blocking could proceed in any manner in which the optical center 34 locations and major axis 36 orientations are known relative to the coordinate system of the block 10 and machine.

Figure 4:
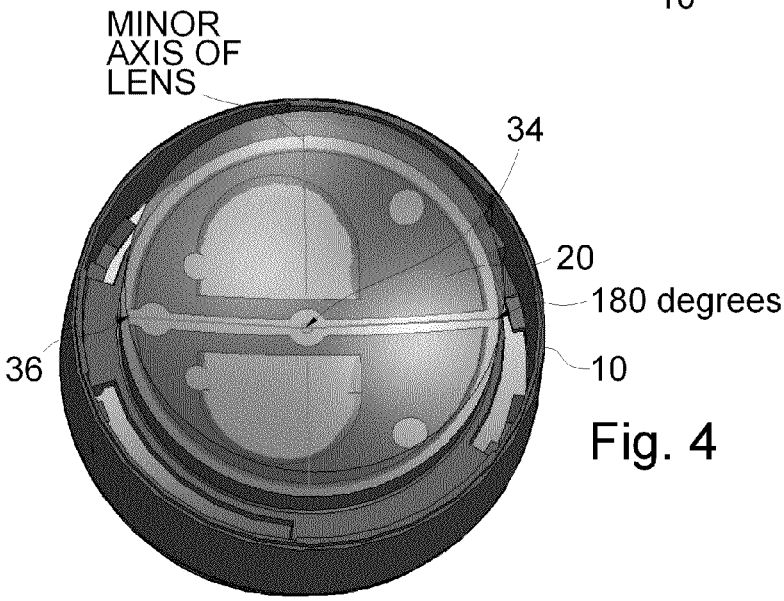
FIG. 4 shows a top plan view of a pre-mounted lens blank and block assembly used for generating an ophthalmic lens from a lens blank in accordance with the present invention.

FIG. 4 shows a Class 1 Finished Uncut lens blank 20 with a lens power of −2.00 sphere combined with −1.00 of Cylinder ("Cylinder" is for the correction of astigmatism) with its optical center 34 over the center of the block 10 and with the Major Axis 36 of the lens aligned with the 0-180 meridian of the Block 10. With the lens blank 20 blocked in this manner, it is then just a matter of machining the shape of the final lens 30 into the lens blank 20 with the correct axis orientation and with the correct amount of lateral and vertical decentrations required by the prescription.

Figure 5:
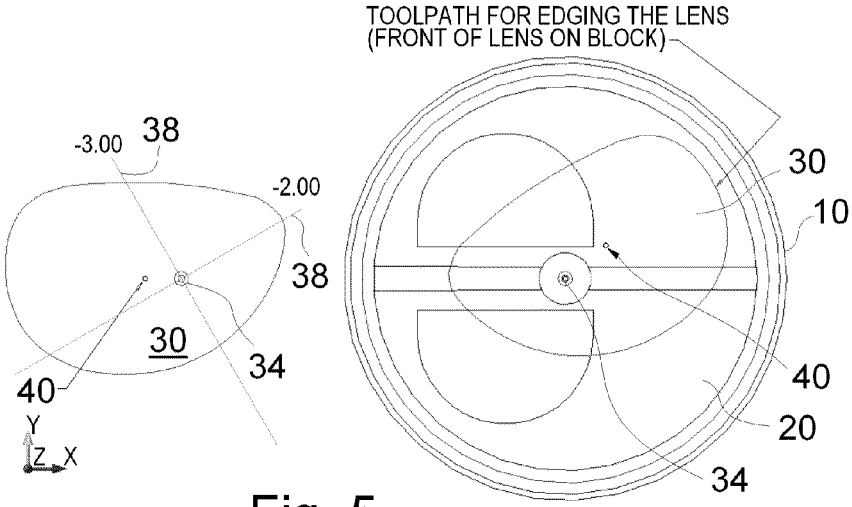
FIG. 5 shows a top schematic view of a pre-mounted lens blank and block assembly of FIG. 4.

FIG. 5 illustrates a Class 1 Finished Lens 30 (front forward) on the left with Optical Axis 38 Orientations and Optical Center 34 and Geometric Center 40 locations noted. In FIG. 5 on the right (front of lens facing away) is shown the Orientation and Shape of the tool path for Edging the lens 30.

FIG. 4 shows the same −2.00 −1.00 lens 30 as in FIG. 5. In the example in FIG. 5, the Lens Prescription specifies an axis location of 30 degrees so the lens 30 profile is shown rotated relative to the major axis 36 of the lens blank 20 in a manner appropriate for orienting the major axis 36 at 30 degrees in the finished lens 30. Note that the Geometric Center (GC) 40 of the finished lens 30 is not coincident with the Optical Center (OC) 34 of the lens 30. It is unusual for the two "centers" coincide. The edges of the lenses 30 must be formed so that they are kept essentially parallel to the normal at the GC 40 of the finished lens 30. Without articulation edging, the edges of the lens 30 would not end up parallel with the normal at the Geometric Center 40 (e.g., edges would be skewed) except in the relatively rare instances where the optical centers 34 and geometric centers 40 of the lens 30 coincide.

Since the optical centers 34 of Finished Uncut lenses 40 are located over the centers of the blocks 10 during blocking, the axis of rotation 42 of the lens blank 20 during edging is coincident with the optical axis of the lens 30 through the optical center 34. In order to form edges in lens 30 that are substantially parallel to the normal to the final GC 40 (when the GC and OC are not coincident), the rotary cutting or grinding tool 32 must be capable of being angled relative to the axis of rotation 42 of the lens blank 20. This is done in the NCRx Ophthalmic Lens Manufacturing System with what is called herein "Articulation Edging". "Articulation Edging" involves constantly changing the angle of the tool axis of tool 32 relative to the lens' axis of rotation 42 during edging in order to keep the edges of the lens 30 substantially parallel to the normal at the GC 40.

Figure 6:
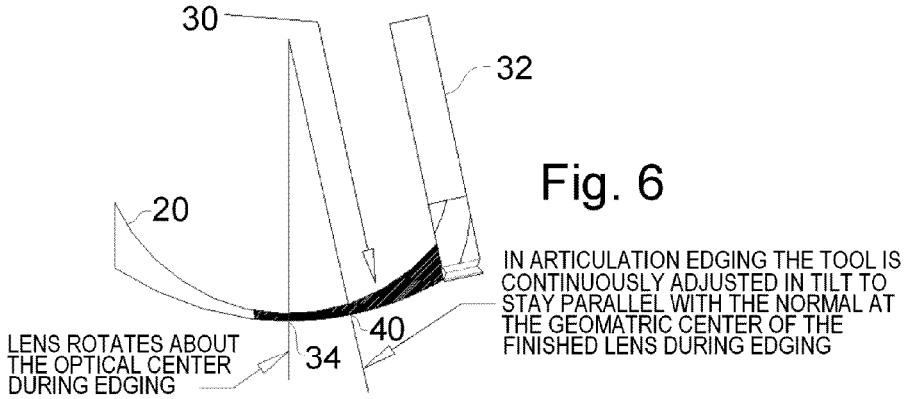
FIGS. 6 and 7 schematically illustrate articulation edging in accordance with the present invention.
Figure 7:
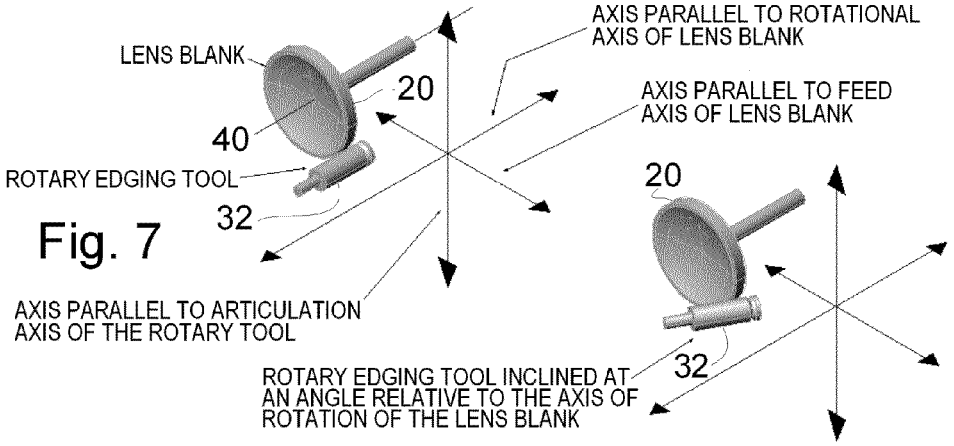
Figure 8:
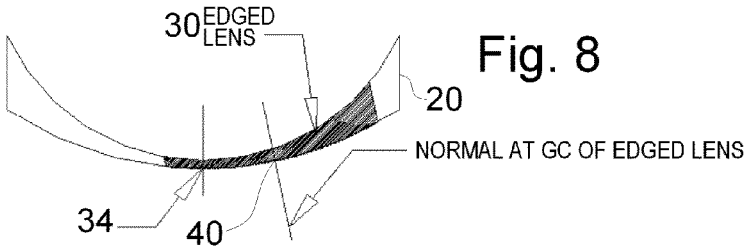
FIG. 8 is a schematic side view of a final lens with articulated edges in accordance with the present invention.
Figure 9:
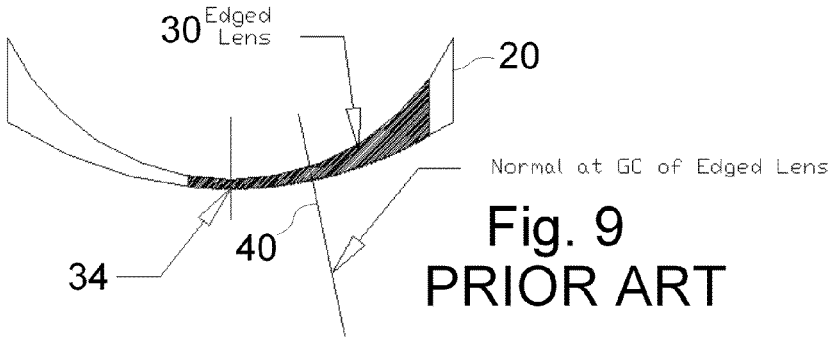
Fig. 9 PRIOR ART
FIG. 9 is a schematic side view of a final lens with edged formed by standard edging.

Articulation edging is shown in FIGS. 6-8, wherein during edging, the lens blank 20 rotates about the Optic Axis, since the lens blank 20 is blocked with the OC 34 of the lens 30 over the center of the block 10 aligned with axis 42. The rotary axis of the cutting tool 32 is continuously adjusted in tilt so as to constantly remain substantially parallel with the normal at the Geometric Center 40 of the finished lens 30, as shown in the mechanics illustrated in FIG. 7. This keeps the edges of the finished lens 30 as shown in FIG. 8 essentially parallel with the Normal at the GC 40. Failure to do Articulation edging in these cases would result in skewed edges as shown in FIG. 9 which schematically illustrates the general prior art in which the GC 40 is offset from the rotational axis of the mounted lens blank 20. Skewing of the edges of the finished lens 30 can make mounting the lens 30 in the frame difficult and not secure, and the skewed edges can simply look funny and thus be cosmetically objectionable.

Pre-blocking for this first class of lens blanks 20, Finished Uncuts, is made possible by standardizing the locations and orientations of the Optical Centers 34 and Major Axes 36 on the blocks 10 during blocking and by the process of "Articulation Edging" wherein the edges of the lenses 30 are made essentially parallel to the normal at the Geometric Center 40 of the final lens 30.

Blocking Group 2—Semi-Finished Single Vision Lens Blanks 20:

Pre-Blocking for the second group, SFSV Lens Blanks, is simple. In this system, all SFSV lens blanks 20 are blocked with the center of the lens blank 20 approximately over the center of the block 10 and with the front surface of the lens blank 20 in contact with the locator ring 22, generally (see FIG. 2). It is not necessary for the center of the lens 30 to be precisely located over the center of the block 10.

Surfacing a lens blank 20 blocked in this manner can proceed in at least two ways within this system. The back surface can be generated so that the optical center 34 of the lens 30 being generated is located in the center of the blank 20. This method requires "Articulation Edging" under the present invention for forming the edges of the lens 30. As explained above when the Optical Center (OC) 34 and the Geometric Center (GC) 40 of the final lens 30 are not coincident, which they rarely are, articulation edging is needed to avoid skewing the final edge.

Alternately, the back surface can be generated so that the Geometric Center 40 of the Finished Lens 30 after edging is located in the center of the block 20. When generating this way, less expensive smaller diameter lens blanks 20 can be used, and simpler "Standard Edging" can be employed. It should be apparent that the NCRx Ophthalmic Lens Manufacturing System is not limited to articulation edging and can easily accommodate such standard edging. To reiterate, "Standard Edging" (as opposed to "Articulation Edging") is an edging procedure wherein the axis of rotation of the tool 32 doing the edge grinding or edge cutting remains parallel to the axis of rotation 42 of the lens 30 during the edging process.

Surfacing of Semi-Finished Lens Blanks 20 where the GC 40 of the final lens 30 is made coincident with the center of the block 20 (by manipulation of the surfacing process variables), effectively requires that the diamond lathing tool encounter a surface that is not "flat" in the center (unless the GC 40 and OC 34 are coincident—which is extremely uncommon). Normal lathing which utilizes a simple spiraling tool path from the outer edge of a lens all the way to center creates "digs" (lathing flaws) at the center if the surface is tilted at the center. With the GC 40 rather than the OC 34 in the center of the block 10, the back surface will almost always be tilted at the center. Several machining solutions have been proposed in the lathing art for machining at such a "tilted" center such as a process known as an "interrupted cut". The NOLM System can accommodate such lathing techniques to accommodate the tilted center to avoid subsequent processing steps such as polishing down large bumps at the centers and to avoid lathing "digs" at the center of a tilted surface. The present invention is not intended to be limited to one "tilted center" lathing technique. Changing the speed and angle of the tool also offers solutions to this work piece configuration issue and any solution can effectively be implemented with the NOLM System.

Pre-Blocking of this second class of lens blanks, Semi-finished Single Vision Lens Blanks 20 is made possible by the ability to locate the lens blank 20 front surface relative to known block coordinates, by Articulation Edging which keeps the edges substantially parallel to the normal at the GC 40 of the final lens 30, and surfacing using a machining platform that allows for implementing lathing techniques for lathing surfaces that are tilted in the center to enable placement of the optical 34 and geometric centers 40 anywhere on the lens 30 and not just at the center of rotation (axis 42) during lathing.

Figure 10:
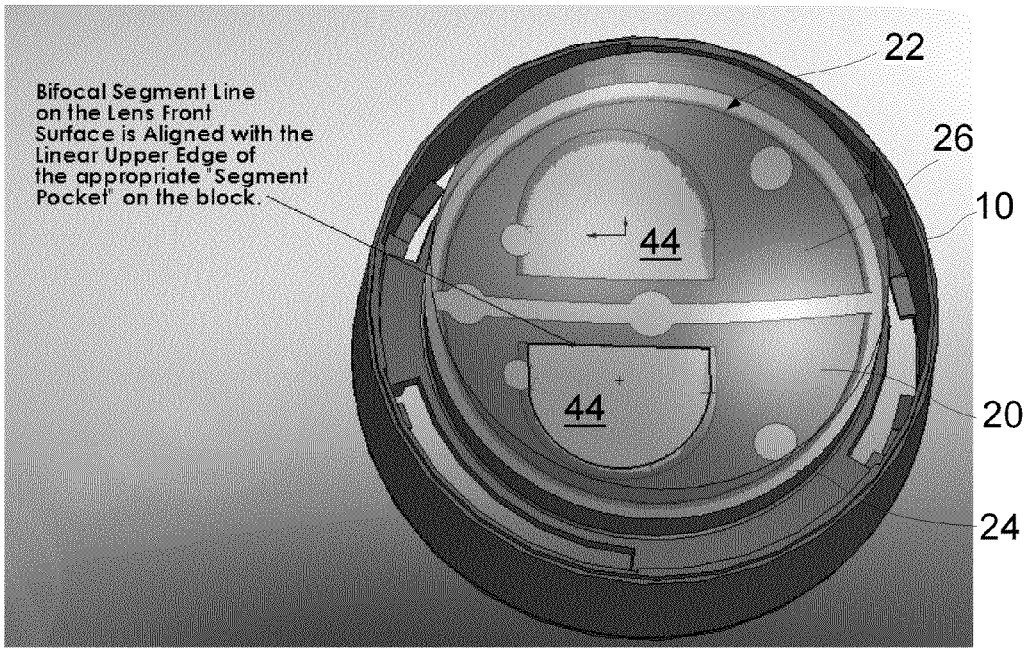
FIG. 10 is a top plan view of a pre-mounted lens blank and block assembly used for generating an ophthalmic lens from a lens blank in accordance with the present invention.

Blocking Group 3—Semi-Finished Lined Multifocal Lens Blanks 42:

Pre-Blocking for the third class of lens blanks 20, Semi-Finished Lined Multifocal Lens Blanks 20, requires locating the Multifocal Segment (Bifocal or Trifocal) of these lens blanks at a known location and orientation relative to the blocks. The molded blocks have features to facilitate this alignment. The blocks 10 have pockets 44 (depressions) that provide for clearance for the segments since the multifocal segments physically protrude from the front surfaces of polymer based lens blanks 20. When the lens blanks 20 are blocked in this manner as shown in FIG. 10, the lens blank's front surface location and the location and orientation of the front surface multifocal features are known with adequate precision relative to the block's coordinates. Surfacing calculations and surfacing machining operations are then performed so that the optical center 34 location (specified in the Rx) is placed at the proper location on the lens 30 relative to the known location and orientation of the multifocal segment.

Edging calculations and edging machining operations are performed so that the final Geometric Center (GC) 40, optical features, and the segment location are properly placed on the final edged lens 30. It will most often be the case that the final GC 40 will not fall over the center of the lens blank 20 (around which the lens rotated during edging—axis 42), so "Articulation Edging" will be required in order to keep the edges substantially parallel to the Normal at the GC 40 of the final lens 30.

Pre-Blocking of Front Surface Lined Multifocal Lens Blanks 20 is made possible by the ability to locate and orient the lens segment on the blank relative to known block coordinates, by the use of a machining platform that allow for lathing surfaces that are tilted in the center to enable placement of the optical center anywhere on the lens, and by Articulation Edging which keeps the edges parallel to the normal at the GC 40 of the final lens 30.

Blocking Group 4—Lens Blanks 20 with Unusual and/or Aspheric Front Surfaces:

Lenses 30 with unusual front surfaces like Executive Bifocals or Front Surface PAL's are pre-blocked by machining the blocks 10 using the CNC capabilities of the NCRx machining platform itself to machine the appropriate shapes, features, and curves into a block 10. The "features" can include engraved lines to facilitate the alignment of these special lens blanks 20. Lens blanks 20 blocked on these "custom" surfaced blocks are then surfaced and edged like other Semi-Finished Lens Blanks discussed above. The earlier patent applications in this family describe this aspect of the present blocking system in detail. As was noted in those earlier filings, any lens, not just unusual or seldom used types of lenses, can be pre-blocked in this manner.

Turning to automatic lens blank species identification, the Blocks 10 used in the NCRx Pre-Blocking system described herein are provided with barcode markings. These markings indicate the species of the lens blank 20 affixed to the Block 10. The species of a lens blank 20 can be defined by a number of variables and properties such as: lens material, index of refraction, front surface specification (radius of curvature for spherical surfaces or a topographical description for aspheric surfaces), spherical and cylindrical dioptric powers, lens blank center thickness, the type of coatings that are applied to one or both surfaces of the lens blank, the type of multifocal add for multifocal lens blanks, the dioptric power of the add for multifocal lens blanks, whether it is a right or left lens blank (when applicable), and other lens properties.

The machine and system in this invention reads the barcode before the start of machining operations to ensure that the correct species of lens blank 20 has been selected for the job. This barcode is also used for automated and semi-automated retrieval of the correct lens blanks 20 for a job. Note that the barcode here is not primarily intended to be used for the purpose of tracking a job from station to station in a lab, though it could be used in that way in addition to its main job of lens blank species identification and verification. Indicia other than barcodes such as RFID tags could be used for lens blank species identification and verification in other embodiments of the invention.

Having described the features, discoveries and principles of the invention, the manner in which it is constructed and operated, and the advantages and useful results attained; the new and useful structures, devices, elements, arrangements, parts, combinations, systems, equipment, operations, methods and relationships are set forth in the appended claims. Whereas particular embodiments of this invention have been described above for purposes of illustration, it will be evident to those skilled in the art that numerous variations of the details of the present invention may be made without departing from the invention as defined in the appended claims.

What is claimed is:

1. A method of processing ophthalmic lenses from lens blanks comprising the steps of selecting a lens blank assembly responsive to an eyeglass prescription, wherein the lens blank assembly is comprised of a lens blank mounted to a block; and machining the lens blank responsive to the eyeglass prescription for a patient wherein the machining includes edging of the lens blank and wherein the edging of the lens blank includes changing the angle of the edging tool axis relative to the lens' axis of rotation during edging in order to keep the edges substantially parallel to the normal at the geometric center of the finished lens, wherein machining of ophthalmic lens includes simultaneously machining left and right ophthalmic lens from the blocked lens blanks on a single machining platform.

2. The method according to claim 1, wherein the lens blanks in at least some of the lens blank assemblies are finished uncut lens blanks.

3. The method according to claim 1, wherein the lens blanks in at least some of the lens blank assemblies are semi-finished single vision lens blanks, wherein the machining of the semi-finished single vision lens blanks require both back surface surfacing and edging.

4. The method according to claim 1, wherein the lens blanks in at least some of the lens blank assemblies are Front Surface Lined Multifocal Semi-Finished Blanks, wherein the machining of the semi-finished single vision lens blanks require both back surface surfacing and edging.

5. Method of manufacturing ophthalmic lenses comprising the steps of a) mounting lens blanks on lens blocks at one manufacturing facility; and b) selectively machining ophthalmic lens from the blocked lens blanks at another manufacturing site on a machining platform, wherein the selective machining of ophthalmic lens includes articulation edging of the lens.

6. The method of manufacturing ophthalmic lenses according to claim 5 wherein the selective machining of ophthalmic lenses includes simultaneously machining left and right ophthalmic lenses on the machining platform.

7. The method of manufacturing ophthalmic lenses according to claim 5 wherein the machining of each lens blank includes machining a back surface of the lens blank responsive to data representative of an eyeglass prescription.

8. The method of manufacturing ophthalmic lenses according to claim 5 wherein each lens blanks remains blocked throughout the back surface generation and the edging of the lens blanks.

9. The method of manufacturing ophthalmic lenses according to claim 5 wherein the lens blanks are mounted on the lens blocks at the blocking manufacturing facility without regard to specific lens prescription data.

10. The method of manufacturing ophthalmic lens according to claim 5 wherein the blocked lens blanks includes identifying indicia indicative of a species of lens that may be machined from the blocked lens blank.

11. The method of manufacturing ophthalmic lenses wherein the lens blanks are mounted on the lens blocks at the blocking manufacturing facility without regard to specific frame dimension data.

12. The method of manufacturing ophthalmic lenses according to claim 11 wherein the blocked lens blanks will be transported to a plurality of manufacturing locations from a single blocking manufacturing facility.

13. The method of manufacturing ophthalmic lens according to claim 11 wherein the blocked lens blanks includes identifying indicia indicative of a species of lens that may be machined from the blocked lens blank.

14. The method of manufacturing ophthalmic lenses according to claim 11 wherein the mounting of the lens blanks on the lens blocks is done at a first manufacturing facility and further including the step of transporting the blocked lens blanks to at least a second lens manufacturing facility that is remote from the first blocking manufacturing facility, and wherein the selective machining of the ophthalmic lens from the blocked lens blanks is at the manufacturing site of the machining platform.

15. The method of manufacturing ophthalmic lens according to claim 11 wherein the selective machining of ophthalmic lens includes simultaneously machining left and right ophthalmic lens from the blocked lens blanks at the manufacturing site on the machining platform.

16. The method of manufacturing ophthalmic lens according to claim 11 including the step of selectively machining ophthalmic lens from the blocked lens blanks on a machining platform, wherein the selective machining of ophthalmic lens includes articulation edging of the lens.

17. The method of manufacturing ophthalmic lens according to claim 16 wherein the blocked lens blanks includes identifying indicia indicative of a species of lens that may be machined from the blocked lens blank.

18. The method of manufacturing ophthalmic lens according to claim 17 wherein the selective machining of ophthalmic lens includes simultaneously machining left and right ophthalmic lens from the blocked lens blanks at the manufacturing site on the machining platform.

19. The method of manufacturing ophthalmic lens according to claim 18 wherein the mounting of the lens blanks on the lens blocks is done at a first manufacturing facility and further including the step of transporting the blocked lens blanks to at least a second lens manufacturing facility that is remote from the first blocking manufacturing facility, and wherein the selective machining of the ophthalmic lens from the blocked lens blanks is at the manufacturing site of the machining platform.

* * * * *